US006030182A

United States Patent [19]

Voigt

[11] Patent Number: 6,030,182

[45] Date of Patent: Feb. 29, 2000

[54] VARIABLE DISPLACEMENT PUMP AND OPTIONAL MANUAL OR REMOTE CONTROL SYSTEM THEREFOR

[75] Inventor: Michael J. Voigt, Chanhassen, Minn.

[73] Assignee: Eaton Corporation, Cleveland, Ohio

[21] Appl. No.: 08/953,145

[22] Filed: Oct. 17, 1997

Related U.S. Application Data

[63] Continuation-in-part of application No. 08/618,149, Mar. 19, 1996, abandoned.

[51] Int. Cl.[7] ..... F04B 1/26

[52] U.S. Cl. ..... 417/222.1; 60/444

[58] Field of Search ..... 60/444; 417/222.1, 417/305

[56] References Cited

U.S. PATENT DOCUMENTS

| | | | |
|---|---|---|---|
| Re. 31,657 | 9/1984 | Caruso | 417/222 |
| 3,152,445 | 10/1964 | Weisenbach | 60/53 |
| 3,463,087 | 8/1969 | Grant | 103/38 |
| 3,817,150 | 6/1974 | Cox . | |
| 4,050,247 | 9/1977 | Connett | 60/444 |
| 4,158,529 | 6/1979 | Nonnemacher et al. | 417/216 |
| 4,183,419 | 1/1980 | Henn et al. . | |
| 4,204,457 | 5/1980 | Cyrot | 91/31 |
| 4,274,257 | 6/1981 | Koch, Jr. et al. | 60/444 |
| 4,463,559 | 8/1984 | Holdenried | 60/444 |

*Primary Examiner*—Timothy S. Thorpe
*Assistant Examiner*—Cheryl J. Tyler
*Attorney, Agent, or Firm*—L. J. Kasper

[57] ABSTRACT

A variable displacement pump assembly (11) of the type including a tiltable swashplate (29) to vary the pump displacement. The assembly includes a main control valve (43) having a housing (44). The assembly includes an input section (65) disposed between the valve housing (44) and the pump housing (61). The input section (65) defines a cylinder bore (77, 79) in which a piston member (81) is disposed and is connected by a mechanical input (59) to a valve spool (51) of the main control valve. The piston defines first (87) and second (89) piston chambers and a solenoid valve (105) is responsive to a remote electrical input signal (111, 113) to control the fluid pressure in the piston chambers, and therefore, the position of the valve spool (51). The mechanical linkage (91,99,101) between the piston (81), the valve spool (51) and the swashplate (29) is totally enclosed within the valve housing (44) and the body portion (67) of the input section, thus eliminating the need for remote mechanical control cables, and improving the reliability of the control system. The control of the present invention thus enables the vehicle operator to vary pump displacement by either a manual input to the main control valve (43) or by varying the electrical input signal (111, 113).

9 Claims, 4 Drawing Sheets

VARIABLE DISPLACEMENT PUMP AND OPTIONAL MANUAL OR REMOTE CONTROL SYSTEM THEREFOR

This application is a continuation in part of application Ser. No. 08/618,149 filed Mar. 19, 1996, now abandoned.

BACKGROUND OF THE DISCLOSURE

The present invention relates to variable displacement hydrostatic pumps and controls therefor, and more particularly, to such pumps which are operated in response to a remote electrical input signal.

Although the present invention may be utilized with various types of pumps, it is especially advantageous when used with an axial piston pump, wherein the displacement of the pump is controlled by movement of a tiltable swashplate, and the invention will be described in connection therewith.

By way of example only, variable displacement hydrostatic pumps of the type to which the present invention relates are widely used in mobile hydraulics, i.e., on various types of moveable (mobile) vehicles. On a large percentage of the mobile vehicle applications, the variable displacement axial piston pump is controlled by a "manual controller" of the type illustrated and described in U.S. Pat. No. 4,050,247, assigned to the assignee of the present invention and incorporated herein by reference. Such a manual controller controls the communication of control pressure from a charge pump to either of a pair of stroking cylinders, which control the tilt of the swashplate and thus, the displacement of the pump, in response to manual movement of a manual input lever. Typically, the manual controller is mounted on an upper surface of the pump housing.

In certain vehicle applications, it is desirable for the vehicle operator to control the displacement of the pump at a time when the operator is nowhere near the pump. In other words, there are times when the operator needs a "remote control" for the pump. One example is on a concrete transit mixer, wherein the drum containing the concrete is rotated by means of a hydrostatic transmission located toward the forward end of the truck, and at the job site, it is frequently desirable for the transit mixer operator to be able to control drum speed while standing near the rear of the transit mixer, observing concrete flowing out of the drum.

On typical transit mixers with hydrostatic drum drives, the remote control from the operator to the pump manual controller is by means of a set of mechanical cables. Conceptually, this form of remote control is acceptable, although the typical cable arrangement is somewhat awkward and inherently limits the freedom of movement of the transit mixer operator. In addition, the mechanical cables require periodic maintenance and replacement because of normal wear and the relatively harsh environment in which the cables are used.

U.S. Pat. No. 4,183,419 discloses a hydrostatic transmission and control system, in which there is a remote electric input signal to a pump equipped with a standard manual controller. This is accomplished by locating a linear electrohydraulic actuation on top of the manual controller, with the output of the actuator connected to the manual input lever of the manual controller. Unfortunately, the arrangement in the above-cited patent results in certain parts of both of electrohydraulic actuator and the manual controller being exposed to the elements and dirt and various other foreign elements which can interfere with the reliable, long-range operation of the control.

In addition, the manner in which the electrohydraulic actuator is associated with the input to the standard manual controller may effectively eliminate the ability to provide a purely manual input to the manual controller.

SUMMARY OF THE INVENTION

Accordingly, it is an object of the present invention to provide an improved remote control system for a variable displacement pump which overcomes the above-described shortcomings of the prior art.

It is a more specific object of the present invention to provide a remote control system for a variable displacement pump wherein the system utilizes the standard manual controller, but responds to a remote electrical input signal, but does not require exposed, external linkages and control members.

The above and other objects of the invention are accomplished by the provision of a variable displacement pump assembly of the type comprising a pump housing defining a pumping chamber, a rotating group disposed in said pumping chamber, and a tiltable swashplate operably associated with the rotating group to vary the fluid displacement thereof, and first and second fluid pressure responsive means for varying the displacement of the swashplate. The assembly includes main control valve means including a valve housing and a valve spool operable in response to movement of a mechanical input to port fluid from a source of control pressure to one of the first and second displacement varying means. A feedback linkage is operable to transmit displacement of the swashplate to the valve spool.

The improved variable displacement pump assembly is characterized by an input section disposed between the pump housing and the valve housing, and including a body portion defining an opening, the feedback linkage extending through the opening. The body portion defines an axially extending cylinder bore, and a piston member is reciprocably disposed in the cylinder bore, and is in operable engagement with the mechanical input to the valve spool, whereby reciprocation of the piston results in actuation of the valve spool. The piston member cooperates with the cylinder bore to define first and second piston chambers operable, in response to the presence of control pressure therein, to move the valve spool in first and second opposite directions, respectively, from a neutral position. The input section further includes an electrohydraulic control operable, in response to an electrical input signal, to control the fluid pressure in the first and second piston chambers, respectively.

DESCRIPTION OF THE PREFERRED EMBODIMENT

Figure 1:
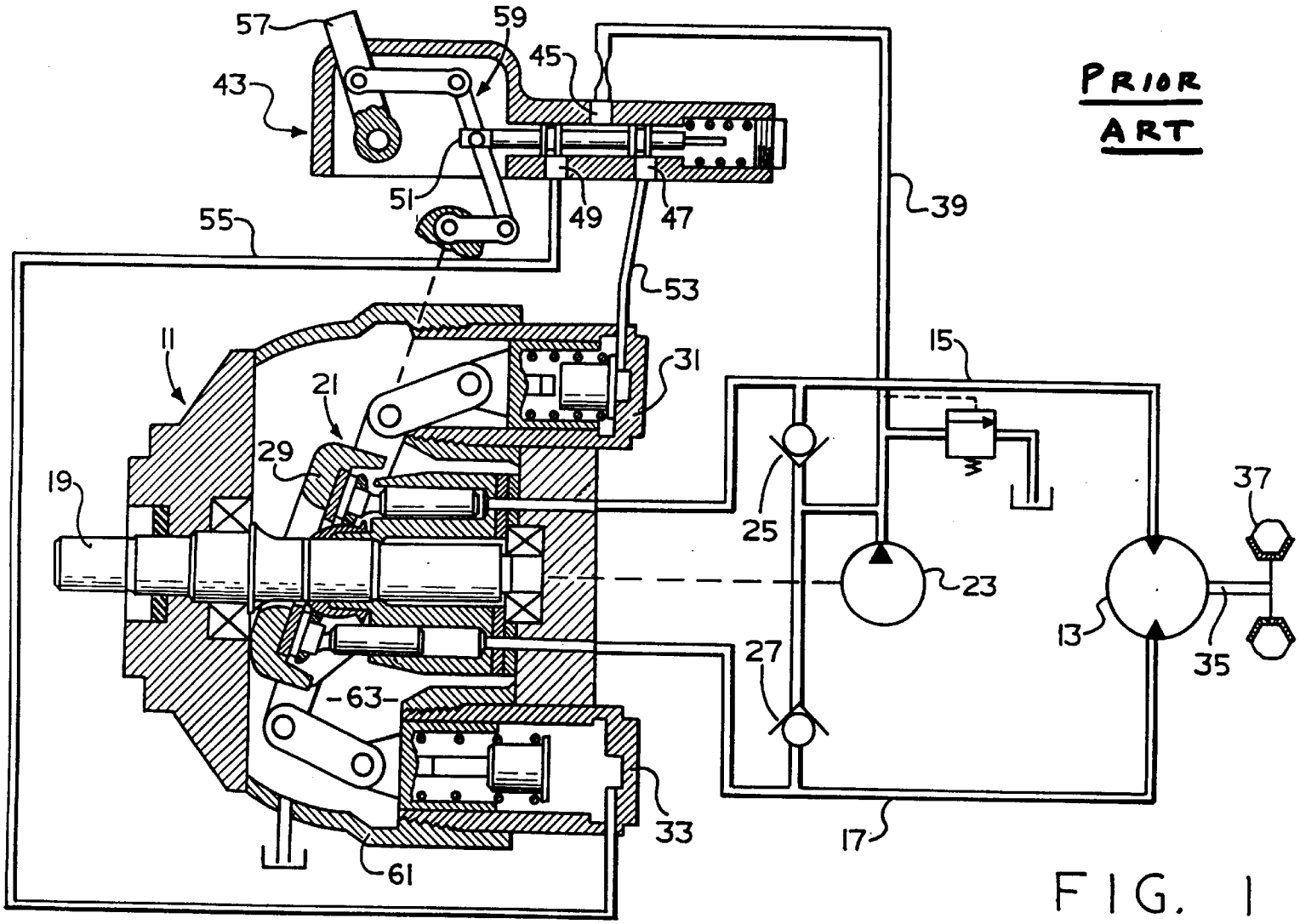
FIG. 1 is an illustration, partly in schematic and partly in cross-section, of a hydrostatic transmission, including a variable displacement hydrostatic pump, and a typical PRIOR ART control system therefor.

Referring now to the drawings, which are not intended to limit the invention, FIG. 1 illustrates a typical hydrostatic transmission of the type to which the present invention relates. The system of FIG. 1 includes a variable displacement axial piston pump, generally designated 11, hydraulically coupled to a fixed displacement motor 13 by means of a pair of fluid conduits 15 and 17. The pump 11 may be of a well-known type including an input shaft 19, which provides the input drive to the rotating group, generally designated 21, as well as to a charge pump 23. The output of the charge pump 23 is the primary source for make-up fluid to either conduit 15, through a check valve 25, or conduit 17, through a check valve 27. As is well known to those skilled in the art, the output of the charge pump 23 is communicated to whichever of the conduits 15 or 17 is at the lower fluid pressure.

The pump 11 further includes a swashplate 29 which is tiltable or pivotable, to vary the displacement of the pump, by means of a pair of stroking cylinders 31 and 33, as is generally well known in the art. Although the stroking cylinders 31 and 33 are illustrated herein as separate cylinders, for simplicity, it is well known in the art to utilize a single piston within a cylinder, but still defining two separate chambers, and references hereinafter to first and second fluid pressure responsive means for varying displacement will be understood to mean and include either arrangement. The motor 13 includes an output shaft 35, which is shown, by way of example only, as being connected to a load, such as a driven wheel 37, used to propel the vehicle on which the hydrostatic transmission system is operating. As mentioned previously, the load may also comprise something such as the drum of a concrete transit mixer truck.

The output of the charge pump 23, in addition to being the make-up fluid to one of the conduits 15 or 17, is communicated by means of a conduit 39 to a control mechanism, to be described subsequently. The hydrostatic transmission system illustrated in FIG. 1 is of the type referred to as a "closed loop" system, primarily because the low pressure return fluid is communicated from the motor 13 through one of the conduits 15 or 17 to the inlet side of the pump 11, with only leakage fluid being communicated to a system reservoir.

Figure 4:
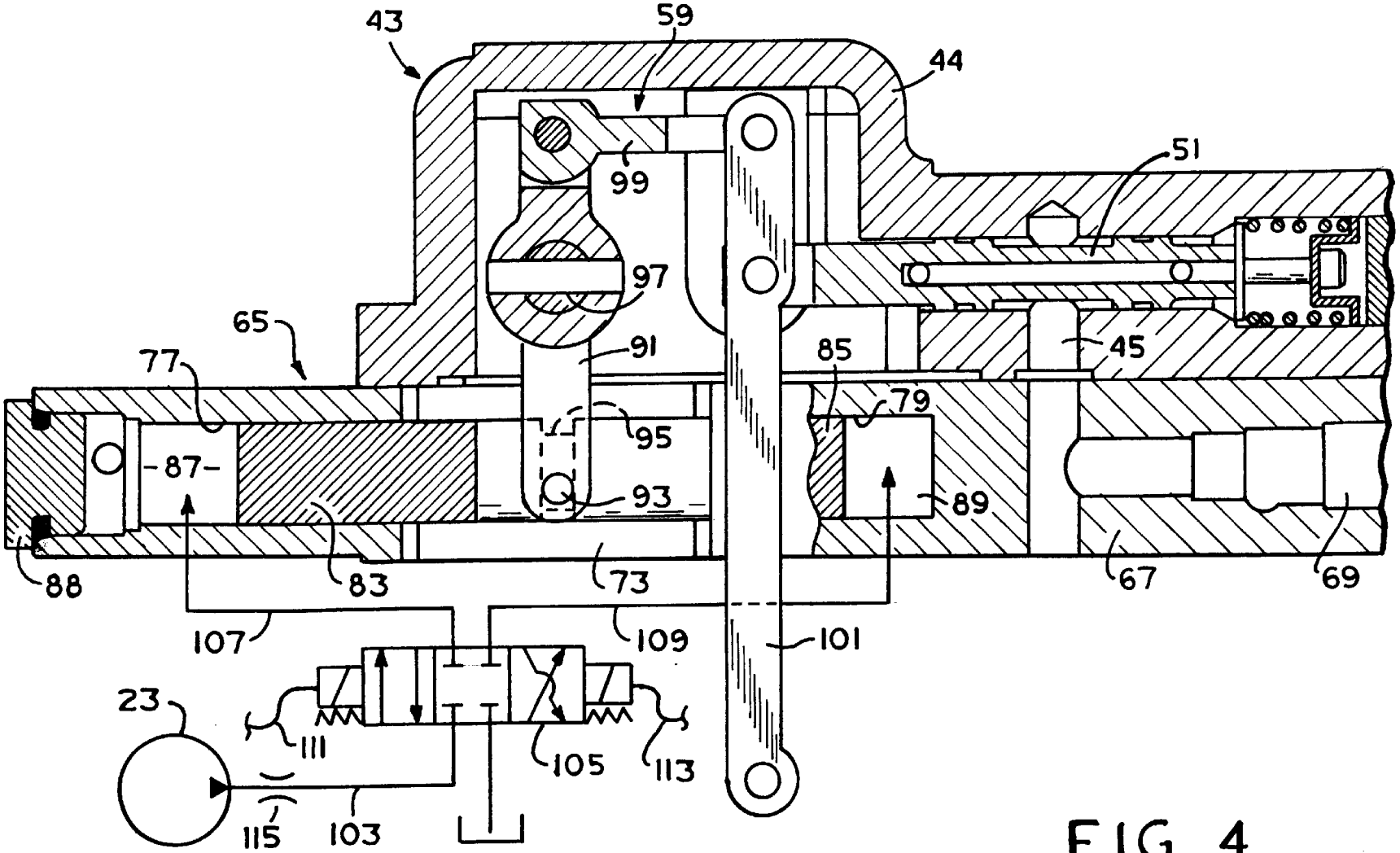
FIG. 4 is an illustration, partly in schematic, and partly in axial cross-section, of the control system shown in FIG. 3.

In the typical PRIOR ART hydrostatic transmission system shown in FIG. 1, the fluid pressures in the stroking cylinders 31 and 33, and therefore the displacement of the swashplate 29, are determined by a manually operated main control valve, generally designated 43, which includes a valve housing 44 (see FIG. 4). Preferably, the main control valve 43 is made in accordance with the teachings of above-incorporated U.S. Pat. No. 4,050,247. Control fluid pressure from the charge pump 23 is communicated by the conduit 39 to a control port 45. Control pressure may be directed to either of a pair of stroker ports 47 or 49, depending upon the position of a control valve spool 51. The stroker port 47 is in fluid communication with the stroking cylinder 31 by means of a conduit 53, and the stroker port 49 is in fluid communication with the stroking cylinder 33 by means of a conduit 55. The control valve 43 includes a manually operated input control lever 57 and linkage, generally designated 59, connecting the control valve spool 51 to the control lever 57, and also to the swashplate 29. As is well known to those skilled in the art, the linkage 59 moves the valve spool 51 to a neutral position when the angular displacement of the swashplate 29 corresponds to the setting of the control lever 57, thereby to maintain the swashplate in that position.

The pump 11 includes a housing 61 which defines a pumping chamber 63. The rotating group 21 and the swashplate 29 are disposed within the pumping chamber 63 in a manner well known to those skilled in the art. By way of example only, the rotating group 21 in the present invention comprises a rotating cylinder barrel, driven by the input shaft 19, and a plurality of pistons reciprocable in cylinders, the axial movement of the pistons within the cylinders, as the barrel rotates, resulting in the pumping of fluid under pressure.

Figure 2:
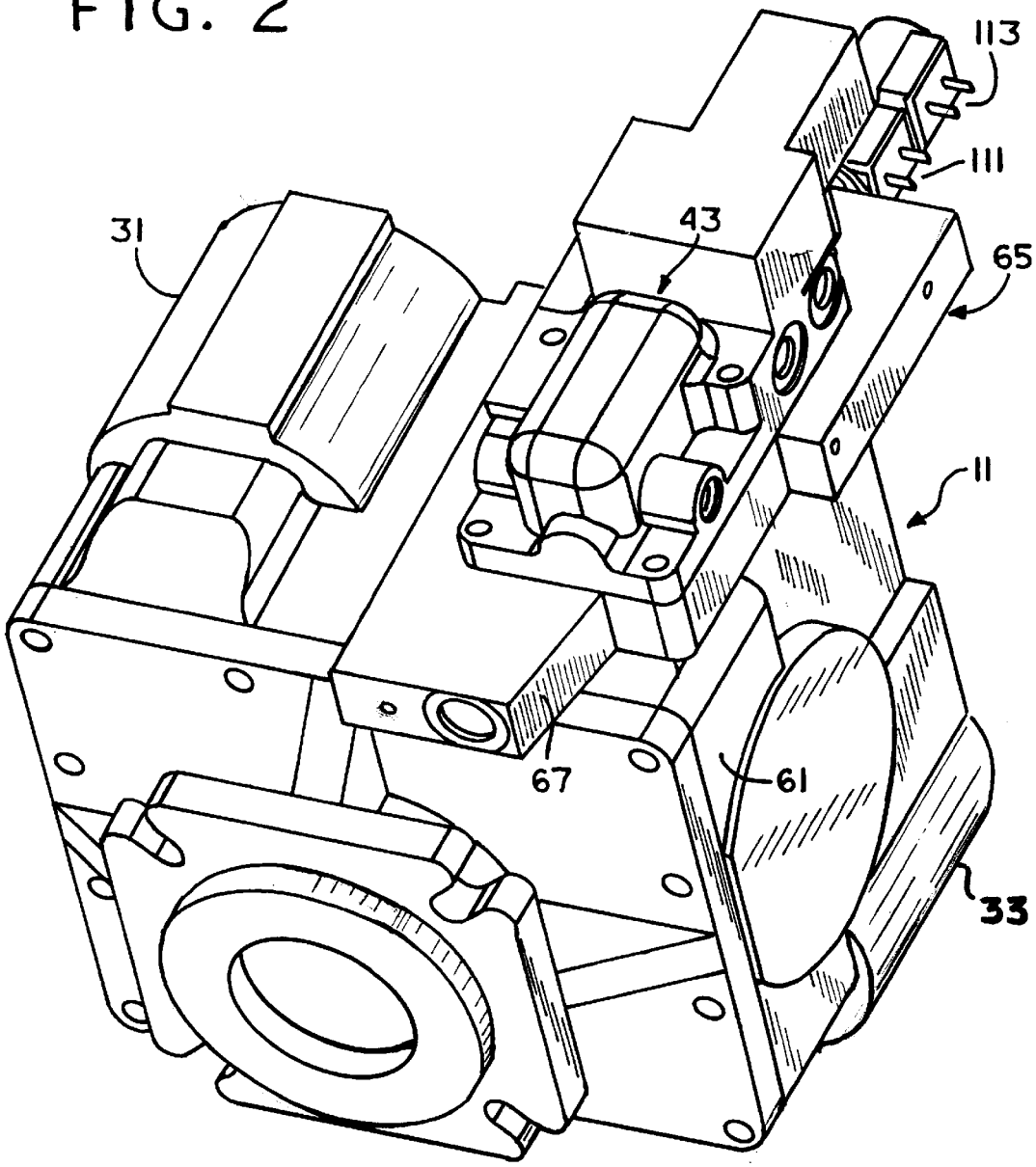
FIG. 2 is a perspective view of the pump shown somewhat schematically in FIG. 1, but including the control system of the present invention.
Figure 3:
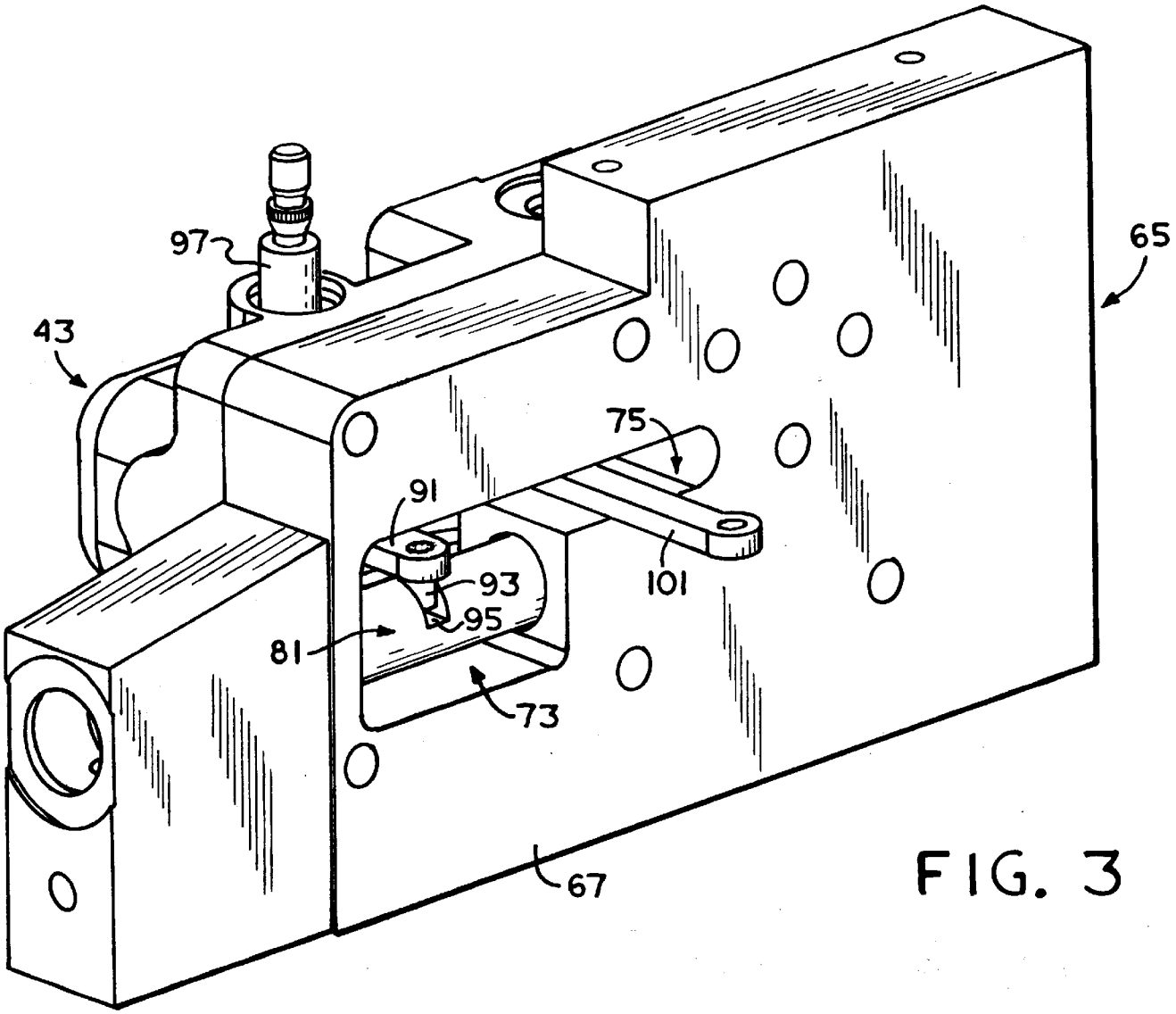
FIG. 3 is a perspective view of the control system of the present invention, but removed from the pump.

Referring now primarily to FIGS. 2 through 4, the control system of the present invention will be described. As was mentioned in the BACKGROUND OF THE DISCLOSURE, the manual controller, as shown in FIG. 1, is normally bolted to an upper surface of the pump 11, adjacent an opening in the pump housing 61, such that the linkage 59 may be connected to the swashplate 29, in the manner shown schematically in FIG. 1.

In the control of the present invention, the main control valve 43 is separated from the pump housing 61 by a remote control input section, generally designated 65, the section 65 being disposed in sandwich fashion between the pump housing 61 and the main control valve 43. The input section 65 includes a body portion 67 which defines an inlet port 69 (see FIG. 4) in fluid communication with the charge pump 23 by means of a conduit which would typically be defined by the pump housing 61 and the body portion 67. From the inlet port 69, control pressure is communicated to the control port 45 of the main control valve 43.

As may best be seen in FIG. 3, the body portion 67 defines an opening, including a relatively larger opening portion 73 and a relatively smaller opening portion 75. Both of the openings 73 and 75 extend throughout the entire vertical thickness or height of the body portion 67, when the input section 65 is in its normal horizontal orientation, as is illustrated in FIG. 4. The openings 73 and 75 are significant to the present invention, for reasons which will become apparent subsequently.

Referring now primarily to FIG. 4, the body portion 67 further defines an axially-extending cylinder bore, which actually includes two separate cylinder bores 77 and 79, separated by the larger opening 73. As will be understood by those skilled in the art, it is important that the cylinder bores 77 and 79 be axially aligned fairly accurately, because disposed therein is a piston member, generally designated 81. The piston member 81 includes a piston portion 83 disposed in the cylinder bore 77, and a piston portion 85 disposed in the cylinder bore 79. The piston portion 83 cooperates with the cylinder bore 77 to define a piston chamber 87, sealed by a plug member 88, and similarly, the piston portion 85 cooperates with the cylinder bore 79 to define a piston chamber 89.

In the control system of the present invention, the linkage, generally designated 59, is somewhat different than in the PRIOR ART system shown in FIG. 1. Referring now to FIGS. 3 and 4, it may be seen that the linkage includes a generally vertical, input link 91 which includes, at its lower end, a pin portion 93 disposed in a notch 95 defined by the piston member 81. The input link 91 pivots about shaft 97 which is fixed relative to the valve housing 44, except for being rotatable relative thereto. The shaft 97 projects out of the valve housing 44 in FIG. 3, thus giving the vehicle operator the ability to manually override the remote electrical input signal.

Pinned to the upper end of the input link 91 is the left end of a drag link 99, with the right end thereof being pinned to the upper end of a feedback linkage member 101. The valve spool 51 is pinned to the feedback linkage member 101 in the same manner as is shown in the PRIOR ART arrangement of FIG. 1. The primary difference in the feedback linkage member 101 of the present invention is its greater length, to compensate for the thickness or height of the body portion 67. The linkage member 101 extends through the smaller opening 75 and is connected to the swashplate 29 in the conventional manner. As may best be seen in FIG. 3, it is important to have the piston 81 and the valve spool 51 transversely offset from each other, so that the linkage member 101 can extend vertically through the body portion 67 and the smaller opening portion 75, without interfering with the piston member 81. The arrangement illustrated and described results in a good, compact package, and therefore, is commercially desirable, although not an essential feature of the claimed invention.

Referring now to FIG. 4, the output of the charge pump 23 is communicated by means of a conduit 103 to a three-position, four-way solenoid-operated valve 105 which controls the communication of control pressure to one of the piston chambers 87 or 89, by means of a pair of conduits 107 and 109, respectively. The conduits 103, 107, and 109 are shown only schematically herein, but it would be understood by those skilled in the art that the conduits would be defined by the pump housing 61 and the body portion 67. Within the scope of the present invention, any appropriate electrohydraulic control may be used which is capable of controlling fluid pressure in the piston chambers 87 and 89, in response to appropriate electrical input signals, represented schematically in FIG. 4 by electrical leads 111 and 113, but illustrated pictorially in FIG. 2. In the subject embodiment, and by way of example only, the electrohydraulic valve 105 is installed in the inlet port 69 of the body portion 67, and the electrical input signals 111 and 113 are merely "ON-OFF" 12 volt signals.

Disposed in the conduit 103 is a fixed orifice 115, the function of which is to control the response time of the control, i.e., the time it takes to move the swashplate 29 from full displacement in one direction to full displacement in the opposite direction. In other words, the larger the orifice 115, the faster the response time, and the smaller the orifice 115, the slower the response time. In the subject embodiment, the swashplate has a displacement of eighteen degrees in either direction from neutral, and by way of example only, an appropriate response time might be eight seconds from full "forward" to full "reverse".

In operation, when an appropriate input signal is transmitted to the electrical lead 111, the valve 105 shifts to the right in FIG. 4, interconnecting the conduits 103 and 107, and pressurizing the chamber 87. The piston member 81 then begins to shift to the right, causing the input link 91 to pivot counter-clockwise about the shaft 97, and moving the drag link 99 to the left. This results in the feedback linkage member 101 pivoting counter-clockwise about its lower end, i.e., about its connection to the swashplate 29. Such movement of the member 101 moves the valve spool 51 to the left, permitting communication of control pressure from the control port 45 to the stroker port 49, thus actuating the stroking cylinder 33, and displacing the swashplate 29 to the position shown in FIG. 1. As is well known to those skilled in the art, the tilting of the swashplate 29, as described above, imparts a follow-up movement, moving the lower end of the linkage member 101 to the right in FIG. 4, which returns the valve spool 51 to its centered, neutral position when the swashplate has been displaced to a position corresponding to the commanded input, as represented by the movement of the piston 81.

Thus, the present invention provides a control system whereby the vehicle operator has the option of controlling pump displacement manually, in the conventional manner, or by varying the electrical input signal 111. In addition, present invention provides such optional control capability in a very simple and compact package, while making it possible still to use the standard manual controller 43, which is especially important in the event of an electrical power failure.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

We claim:

1. A variable displacement pump assembly of the type comprising a pump housing defining a pumping chamber, a rotating group disposed in said pumping chamber, and a tiltable swashplate operably associated with said rotating group to vary the fluid displacement thereof, and first and second fluid pressure responsive means for varying the displacement of said swashplate; a main control valve means including a valve housing and a valve spool operable in response to direct manual movement by a vehicle operator of a mechanical input to port fluid from a source of control pressure to one of said first and second displacement varying means; and a feedback linkage operable to transmit displacement of said swashplate to said valve spool, said mechanical input being in mechanical engagement with said feedback linkage; characterized by:

a) an input section disposed between said pump housing and said valve housing and including a body portion defining an opening, said feedback linkage extending through said opening;

b) said body portion defining an axially-extending cylinder bore, c) a piston member reciprocably disposed in said cylinder bore and in mechanical engagement with said feedback linkage, whereby reciprocation of said piston member results in actuation of said valve spool;

d) said piston member cooperating with said cylinder bore to define first and second piston chambers operable, in response to the presence of control pressure therein, to move said valve spool in first and second opposite directions, respectively, from a neutral position; and e) an electrohydraulic control operable, in response to an electrical input signal, to control the fluid pressure in said first and second piston chambers, respectively; said pump displacement being controlled by one of said manual or electrical input.

2. A variable displacement pump assembly as claimed in claim 1, characterized by said rotating group comprising a rotatable cylinder barrel, and a plurality of pistons reciprocable in cylinders defined by said barrel.

3. A variable displacement pump assembly as claimed in claim 1, characterized by said first and second fluid pressure responsive means comprising first and second stroking cylinders, operably associated with said swashplate, at diametrically opposite locations thereon, for moving said swashplate in first and second opposite directions from a centered, neutral position.

4. A variable displacement pump assembly as claimed in claim 1, characterized by said source of control pressure comprising a charge pump driven by an input shaft, said input shaft also providing an input drive to said rotating group.

5. A variable displacement pump assembly as claimed in claim 1, characterized by said opening being surrounded by said body portion, whereby said feedback linkage is totally enclosed by said valve housing, said body portion and said pump housing.

6. A variable displacement pump assembly as claimed in claim 1, characterized by said valve spool and said feedback linkage lie in a first plane, and said piston member defines an axis which lies in a second plane, said first and second planes being parallel but transversely offset from each other.

7. A variable displacement pump assembly as claimed in claim 1, characterized by said feedback linkage providing mechanical connection between said piston member and said valve spool, said feedback linkage being totally enclosed by said valve housing and said body portion.

8. A variable displacement pump assembly as claimed in claim 1, characterized by said electrohydraulic control comprising a three-position, four-way solenoid valve disposed in series flow relationship between said source of control pressure and said first and second piston chambers.

9. A variable displacement pump assembly of the type comprising a pump housing defining a pumping chamber, a rotating group disposed in said pumping chamber, and a tiltable swashplate operably associated with said rotating group to vary the fluid displacement thereof, and first and second fluid pressure responsive means for varying the displacement of said swashplate; main control valve means including a valve housing and a valve spool operable in response to direct manual movement by a vehicle operator of a mechanical input to port fluid from a source of control pressure to one of said first and second displacement varying means; and a feedback linkage operable to transmit displacement of said swashplate to said valve spool; characterized by:

(a) an input section operably associated with said pump housing and said valve housing and including a body portion;

(b) said body portion defining an axially-extending cylinder bore;

(c) a piston member reciprocably disposed in said cylinder bore and in operable engagement with said mechanical input, whereby reciprocation of said piston member results in actuation of said valve spool;

(d) said piston member cooperating with said cylinder bore to define first and second piston chambers operable, in response to the presence of control pressure therein, to move said valve spool in first and second opposite directions, respectively, from a neutral position;

(e) an electrohydraulic control operable, in response to an electrical input signal, to control the fluid pressure in said first and second piston chambers, respectively; and (f) said mechanical input and said feedback linkage being totally enclosed by said valve housing, said body portion, and said valve housing.

* * * * *